US008311263B2

(12) United States Patent
Huang

(10) Patent No.: US 8,311,263 B2
(45) Date of Patent: Nov. 13, 2012

(54) SPIDER ARRANGEMENT FOR ELECTROMAGNETIC VIBRATOR

(75) Inventor: Hsin Min Huang, Ningbo (CN)

(73) Assignee: Tang Band Industries Co., Ltd., Ningbo, Zhejiang (CN)

( * ) Notice: Subject to any disclaimer, the term of this patent is extended or adjusted under 35 U.S.C. 154(b) by 952 days.

(21) Appl. No.: 12/319,493

(22) Filed: Jan. 7, 2009

(65) Prior Publication Data

US 2010/0172535 A1 Jul. 8, 2010

(51) Int. Cl.
*H04R 1/00* (2006.01)

(52) U.S. Cl. ..... 381/404; 381/403

(58) Field of Classification Search ..... 381/400–410
See application file for complete search history.

(56) References Cited

U.S. PATENT DOCUMENTS

| | | | | | |
|---|---|---|---|---|---|
| 2,141,208 | A * | 12/1938 | Eaves | ..... | 381/165 |
| 2,261,111 | A * | 11/1941 | Engholm | ..... | 381/404 |
| 5,687,247 | A * | 11/1997 | Proni | ..... | 381/398 |
| 6,853,734 | B2 * | 2/2005 | Sahyoun | ..... | 381/404 |
| 2005/0147272 | A1 * | 7/2005 | Hyre et al. | ..... | 381/398 |

* cited by examiner

*Primary Examiner* — Richard A. Booth
(74) *Attorney, Agent, or Firm* — Raymond Y. Chan; David and Raymond Patent Firm

(57) ABSTRACT

A spider arrangement for an electromagnetic vibrator includes an outer rim adapted for mounting to a supporting frame of the electromagnetic vibrator, an inner rim coaxially aligning with the outer rim for mounting to an induction coil of the electromagnetic vibrator, and a plurality of suspension arms radially and evenly extended from the inner rim to the outer rim to enable the inner rim to be moved axially in responsive to an electromagnetic force between the induction coil and a magnetic element. Each of the suspension arms provides a restoring force towards the inner rim for allowing the induction coil to alignedly move in a pistonic motion with respect to the magnetic element in a stable manner.

20 Claims, 11 Drawing Sheets

SPIDER ARRANGEMENT FOR ELECTROMAGNETIC VIBRATOR

BACKGROUND OF THE PRESENT INVENTION

1. Field of Invention

The present invention relates to an electromagnetic vibrator, and more particularly to a spider arrangement for an electromagnetic vibrator, which comprises a plurality of suspension arms radially extended from an inner rim to an outer rim for not only enhancing the amplitude of vibration of the electromagnetic vibrator but also ensuring the induction coil of the electromagnetic vibrator to alignedly move in a pistonic motion with respect to the magnetic element in a stable manner.

2. Description of Related Arts

The speaker having a spider usually comprises a speaker frame, a cone, a voice coil and a speaker spider. The spider connects to the induction coil for connecting and supporting the induction coil. A speaker having good sound quality has several essential factors, one of which is a good spider. A good spider not only needs to have stabilized elasticity force to retain the induction coil and the diaphragm back to its original position with respect to the supporting frame after each induction, but also needs to have sufficient pulling and pushing force applied to the lead wires. The main parameter of speaker is Fo value illustrating the amplitude of vibration of the electromagnetic vibrator.

The conventional spiders are usually made by cotton and synthetic fiber. In order to achieve enough strength and elasticity force, the spiders are usually made in a couple of round plate shape, and put the spiders into Bakelite. Owing that the manufacturing steps are complicated, the quality of the spiders are hard to control and the manufacturing cost is relatively high. Moreover, because the stability of Bakelite is poor, the quality of the speaker always changes over a period of time use.

On the other hand, the relatively vibration force at the diaphragm to pull and push the induction coil may cause the induction wires broken very easy during operation. Moreover, there will be relative pulling and pushing forces applied to the lead wires, stretching force occurred between the lead wires and the cone, and relative pulling force formed between the lead wires and the voice coil. Thus, the chance of losing or insecure contact between the lead wires and other parts of the speaker is relatively great that may lead to sound instability. Or, in the worst case, the conventional speaker may be electrically disconnected when the connection between the wires breaks.

In order to improve strengthen of the spider; some inventor has made some improvements of the structure of the spider. The Chinese patent CN1822716Y and CN2826879 have disclosed a spider to prevent the amplitude from being surge and stabilize amplify of the spider. In those inventions, those inventions are prepared for reinforced parts on the spider to improve strengthen of spider and stabilize its rhythmical wave. However, the structure of the spider is relatively complicated and hard to assemble during manufacturing; meanwhile the efficiency of the spider does not achieve the requirement of customers' need.

SUMMARY OF THE PRESENT INVENTION

A main object of the present invention is to provide a spider arrangement for an electromagnetic vibrator, which comprises a plurality of suspension arms radially extended from an inner rim to an outer rim for not only enhancing the amplitude of vibration of the electromagnetic vibrator but also ensuring the induction coil of the electromagnetic vibrator to alignedly move in a pistonic motion with respect to the magnetic element in a stable manner.

Another object of the present invention is to provide a spider arrangement for an electromagnetic vibrator, wherein when the magnetic element induces the induction coil to move the induction coil up and down along the axis of the electromagnetic provider so as to vibrate the diaphragm for sound production, the cushion effect of the spider arrangement is adapted to retain the induction coil and the diaphragm back to its original position with respect to the supporting frame after each induction.

Another object of the present invention is to provide a spider arrangement for an electromagnetic vibrator, wherein the suspension arms are provided in an even number such that the suspension arms provide evenly restoring forces towards the inner rim.

Another object of the present invention is to provide a spider arrangement for an electromagnetic vibrator, wherein all the suspension arms are identical and are evenly extended between the inner rim and the outer rim, the mutual biasing force of each pair of the suspension arms will be cancelled, such that the resultant force of the suspension arms will be the electromagnetic force to drive the induction coil to move in a pistonic motion.

Another object of the present invention is to provide a spider arrangement for an electromagnetic vibrator, wherein the induction wires are embedded with the suspension arms respectively, the relatively vibration force at the diaphragm to pull and push the induction coil in a pistonic motion will be eliminated along the induction wires so as to prevent the induction wires from being broken during operation. In addition, no suspending wire is required for connection to the induction coil and hence any possible unwanted contact or overlapping of the coil wires and the wire is eliminated.

Another object of the present invention is to provide a spider arrangement for an electromagnetic vibrator, wherein the manufacturing steps for making the spider arrangement is simple so as to lower the manufacturing cost while being time effective.

Another object of the present invention is to provide a spider arrangement for an electromagnetic vibrator, wherein the shape and numbers of the electromagnetic vibrator are changeable so as to meet the different requirements of sound usage.

Another object of the present invention is to provide a spider arrangement for an electromagnetic vibrator which provides higher sound quality, improve durability, and enhance safety for a speaker.

Accordingly, in order to accomplish the above object, the present invention provides a spider arrangement for an electromagnetic vibrator, which comprises a vibration unit, an electromagnetic provider coupled with the vibration unit, and a spider arrangement.

The vibration unit comprises a supporting frame having a front opening and a rear opening coaxially aligning with the top opening, a diaphragm supported at the top opening of the supporting frame, and an induction coil supported within the supporting frame at a rear side of the diaphragm in an axially movable manner.

The spider arrangement comprises an outer rim arranged for mounting to the supporting frame, an inner rim coaxially aligning with the outer rim for mounting to the induction coil, and a plurality of suspension arms radially and evenly extended from the inner rim to the outer rim to enable the inner rim to be moved axially in responsive to an electromagnetic force between the induction coil and the magnetic element. Accordingly, each of the suspension arms provides a restoring force towards the inner rim for allowing the induction coil to alignedly move in a pistonic motion with respect to the magnetic element in a stable manner.

The induction coil, which is affixed to an inner side of the diaphragm to form the vibration unit in a one-piece integrated body, comprises a coil body and a coil wire winding around the coil body and arranged in such a manner that when the current passes through the coil wire, the induction coil unit is electromangentically inducted with the magnetic field of the electromagnetic provider to drive the induction coil move in an axially movable manner so as to generate a vibration force at the diaphragm.

The suspension arms are integrally extended between the inner rim and the outer rim to form a one piece structure by injection molding, wherein the suspension arms provide a cushion effect for the inner rim so as to enable the inner rim not only to be moved axially up and down with respect to the outer rim when a driving force.

Each of the suspension arms has two ends integrally extended from the inner and outer rims respectively to form a one-piece spider structure. In particularly, the suspension arms are provided in an even number such that the suspension arms provide evenly restoring forces towards the inner rim.

The suspension arm has a mirror reverse image of the neighboring suspension arm to form a pair of the suspension arms, such that each pair of the suspension arms provides a mutual biasing force for ensuring the induction coil to freely and alignedly move in a pistonic motion with respect to the magnetic element.

The integral wiring arrangement comprises two or more induction wires embedded with the suspension arms respectively, wherein each of the induction wires has a first terminal extended to the inner rim for electrically coupling with the induction coil and a second terminal extended towards the outer rim for externally connection of the induction coil.

These and other objectives, features, and advantages of the present invention will become apparent from the following detailed description, the accompanying drawings, and the appended claims.

DETAILED DESCRIPTION OF THE PREFERRED EMBODIMENT

Figure 1:
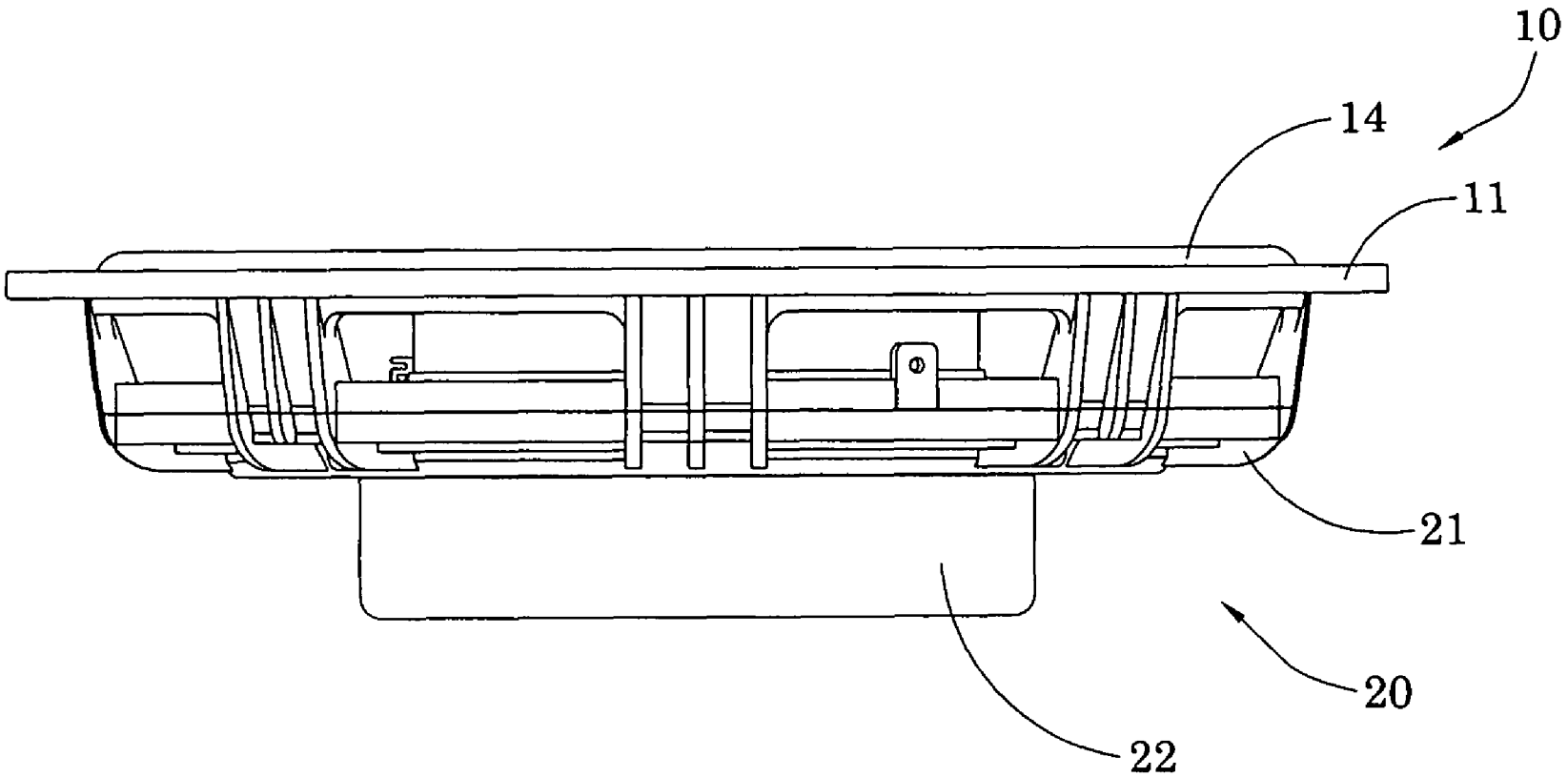
FIG. 1 is a perspective view of an electromagnetic vibrator according to a preferred embodiment of the present invention.

Referring to FIGS. 1 to 4 of the drawings, an electromagnetic vibrator according to a preferred embodiment of the present invention is illustrated, wherein the electromagnetic vibrator, such as a speaker, comprises a vibration unit 10, an electromagnetic provider 20 coupled with the vibration unit, and a spider arrangement 30.

The vibration unit 10 comprises a supporting frame 11 having a front opening 111 and a rear opening 112 coaxially aligning with the top opening 113, a diaphragm 14 supported at the front opening 111 of the supporting frame 11, and an induction coil 15 supported within the supporting frame 11 at a rear side of the diaphragm 14 in an axially movable manner.

The electromagnetic provider 20 comprises a base frame 21 coupling with the supporting frame of the vibration unit 11, and a magnetic element 22 supported within the base frame 21 at the rear opening 112 of the supporting frame 11 to electromangentically communicate with the induction coil 15, wherein when a current passes through the induction coil 15, the induction coil 15 is inducted with respect to the magnetic field, in such a manner that the induction coil 15 is driven to move in an axially movable manner so as to generate a vibration force at the diaphragm 14.

The spider arrangement 30 comprises an outer rim 31 arranged for mounting to the supporting frame 11, an inner rim 32 coaxially aligning with the outer rim 31 for mounting to the induction coil 15, and a plurality of suspension arms 33 radially and evenly extended from the inner rim 32 to the outer rim 31 to enable the inner rim 32 to be moved axially in responsive to an electromagnetic force between the induction coil 15 and the magnetic element 22. Accordingly, each of the suspension arms 33 provides a restoring force towards the inner rim 32 for allowing the induction coil 15 to alignedly move in a pistonic motion with respect to the magnetic element 22 in a stable manner.

The diaphragm 14 comprises a diaphragm layer 141 and a vibration layer 142 integrally affixed to the diaphragm layer 141, wherein the diaphragm layer 141 is made of flexible material to enable the vibration layer to be vibrated.

The induction coil 15, which is affixed to an inner side of the diaphragm 14 to form the vibration unit 10 in a one-piece integrated body, comprises a coil body 151 and a coil wire 152 winding around the coil body 151 and arranged in such a manner that when the current passes through the coil wire 152, the induction coil 15 is electromangentically inducted with the magnetic field of the electromagnetic provider 20 to drive the induction coil 15 move in an axially movable manner so as to generate a vibration force at the diaphragm 14.

According to the preferred embodiment, the spider arrangement 30 has a central opening 34 defining within the inner rim 32 for the induction coil 15 coaxially mounting within the central opening 34. The outer rim 31 of the spider arrangement 30 is arranged for securely mounting at an inner surface of the supporting frame 11.

The suspension arms 33 are integrally extended between the inner rim 32 and the outer rim 31 to form a one piece structure by injection molding, wherein the suspension arms 33 provide a cushion effect for the inner rim 32 so as to enable the inner rim 32 not only to be moved axially up and down with respect to the outer rim 31 when a driving force, i.e. the electromagnetic force, is exerted to the inner rim 32, but also to be retained to an original position after the driving force is released. In other words, when the magnetic element 22 induces the induction coil 15 to move the induction coil 15 up and down along the axis of the electromagnetic provider 20 so as to vibrate the diaphragm 14 for sound production, the cushion effect of the spider arrangement 30 is adapted to retain the induction coil 15 and the diaphragm 14 back to its original position with respect to the supporting frame 11 after each induction.

Figure 5:
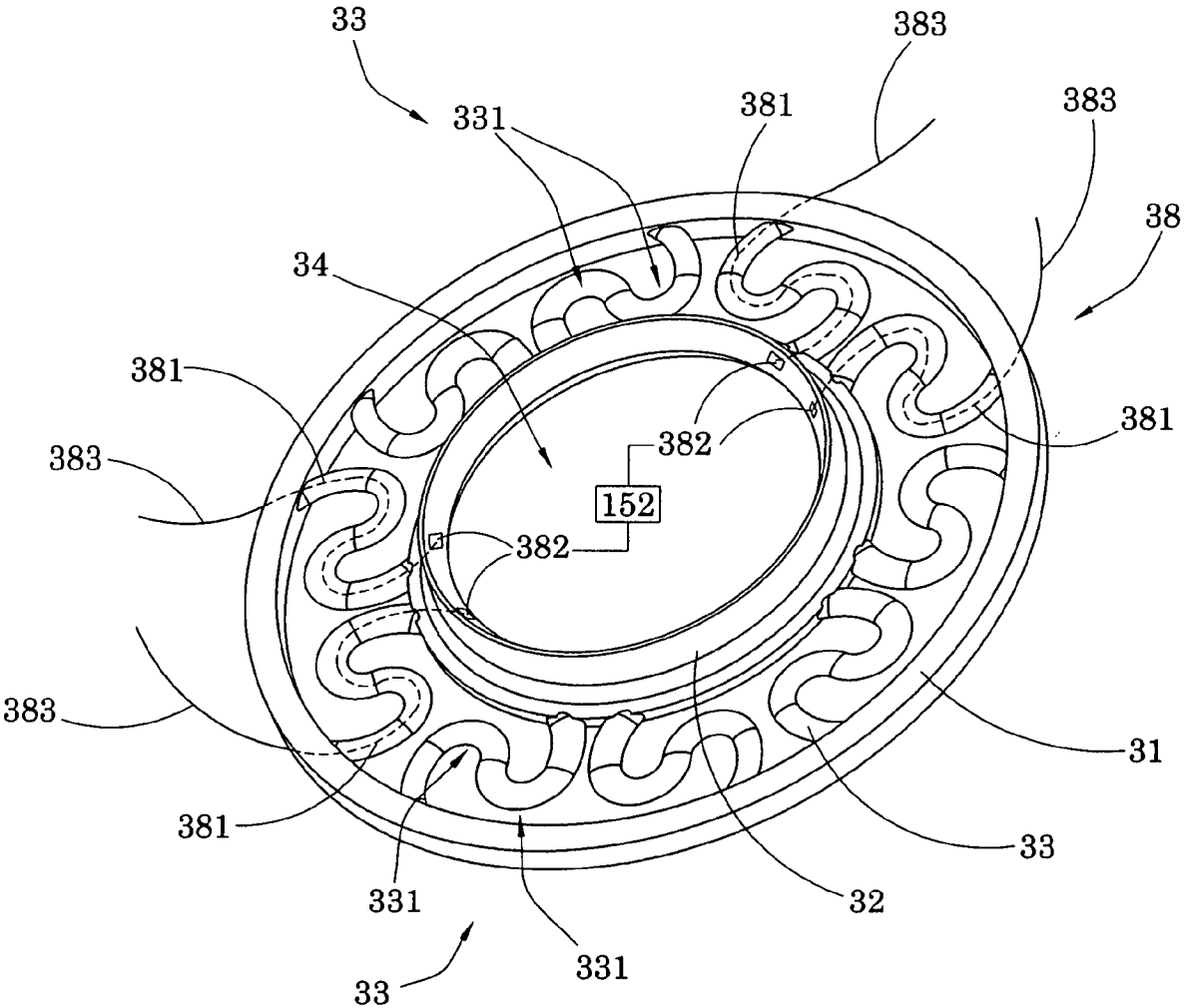
FIG. 5 is a perspective view of the spider arrangement according to the above preferred embodiment of the present invention.
Figure 6:
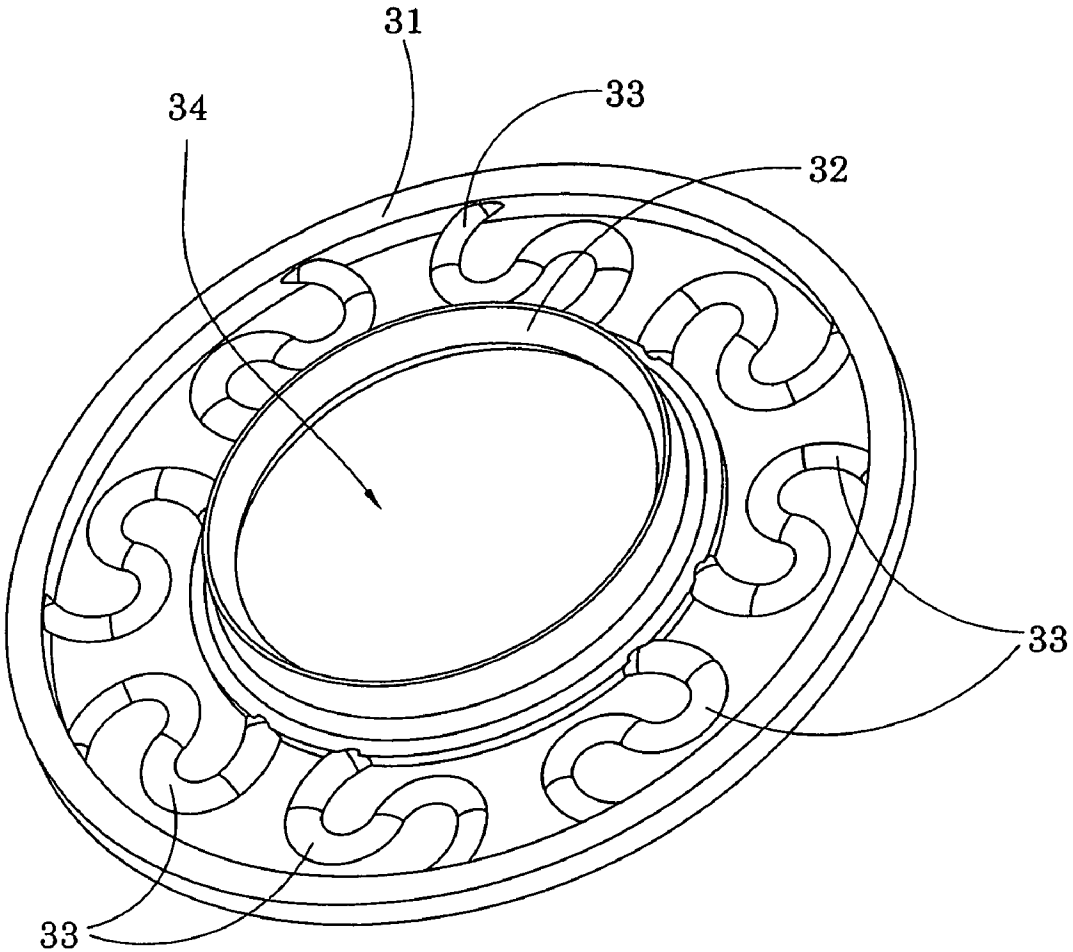
FIG. 6 illustrates a first alternative mode of the spider arrangement according to the above preferred embodiment of the present invention, wherein the embedded integral wiring arrangement is not shown in FIG. 6.

As shown in FIG. 5, each of the suspension arms 33 has two ends integrally extended from the inner and outer rims 31, 32 respectively to form a one-piece spider structure. In particularly, the suspension arms 33 are provided in an even number such that the suspension arms 33 provide evenly restoring forces towards the inner rim 32. For a larger electromagnetic vibrator that a relatively larger vibration force is applied to the diaphragm, as shown in FIG. 5, ten suspension arms, i.e. five pairs of suspension arms, are radially and evenly extended from the inner rim 32 to the outer rim 31. For a smaller electromagnetic vibrator that a relatively smaller vibration force is applied to the diaphragm, as shown in FIG. 6, eight suspension arms, i.e. four pairs of suspension arms, are radially and evenly extended from the inner rim 32 to the outer rim 31. It is worth to mention that at least four suspension arms, i.e. two pairs of suspension arms, are used to provide the even restoring forces to the inner rim.

In order to provide the cushion effect between the inner rim 32 and the outer rim 31, each of the suspension arms 33 is made of flexible material to enable the inner rim 32 to move up and down with respect to the outer rim 31. Each of the suspension arms 33 has at least a curving suspension portion 331 located between the inner and outer rims 32, 31 to provide enough room for the inner rim 32 radially moving in a pistonic motion in responsive to the induction coil 15. In other words, the suspension arms 33 enhance the amplitude of vibration at the induction coil 15.

Figure 2:
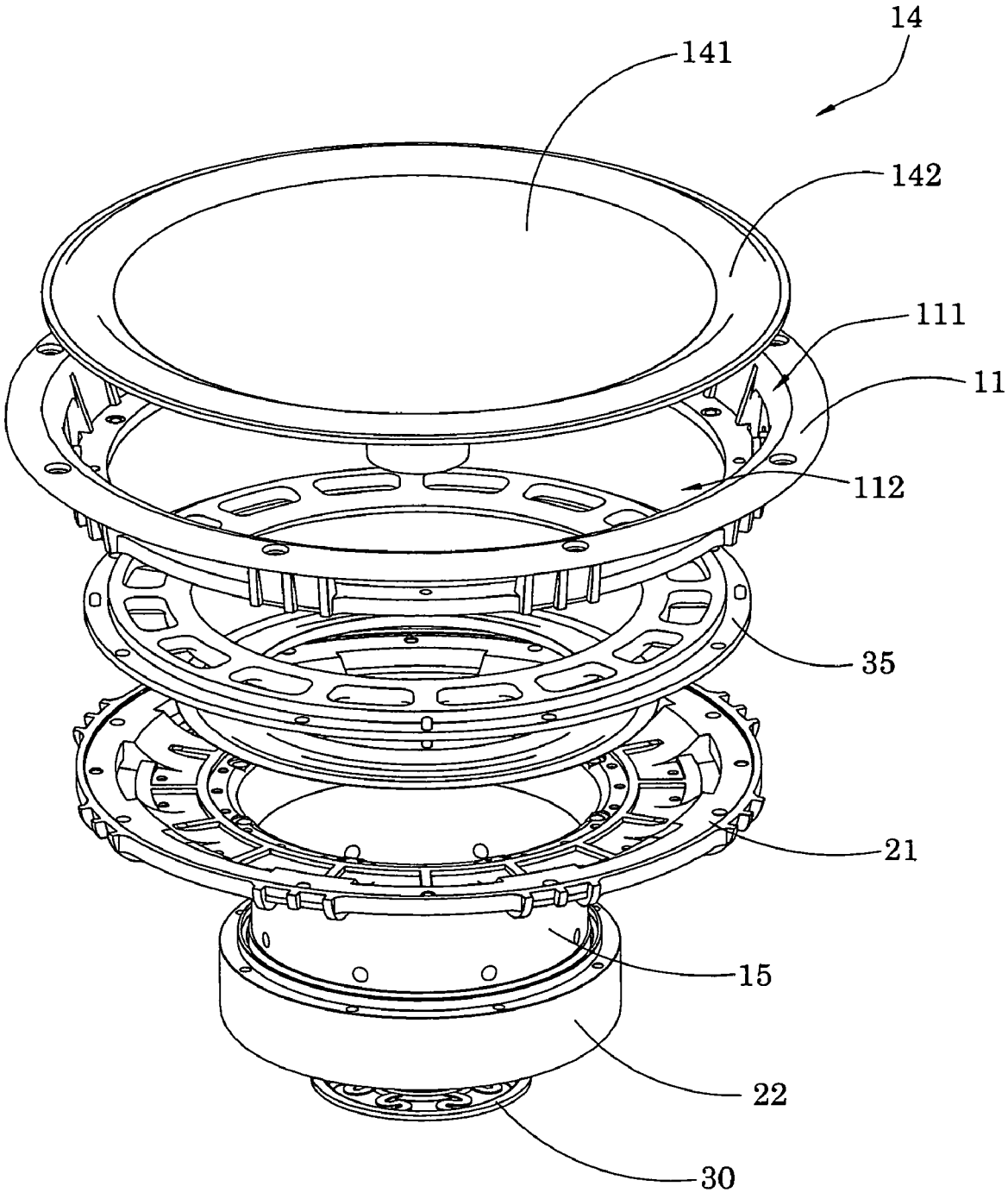
FIG. 2 is a top exploded perspective view of the electromagnetic vibrator with the spider arrangement according to the above preferred embodiment of the present invention.
Figure 3:
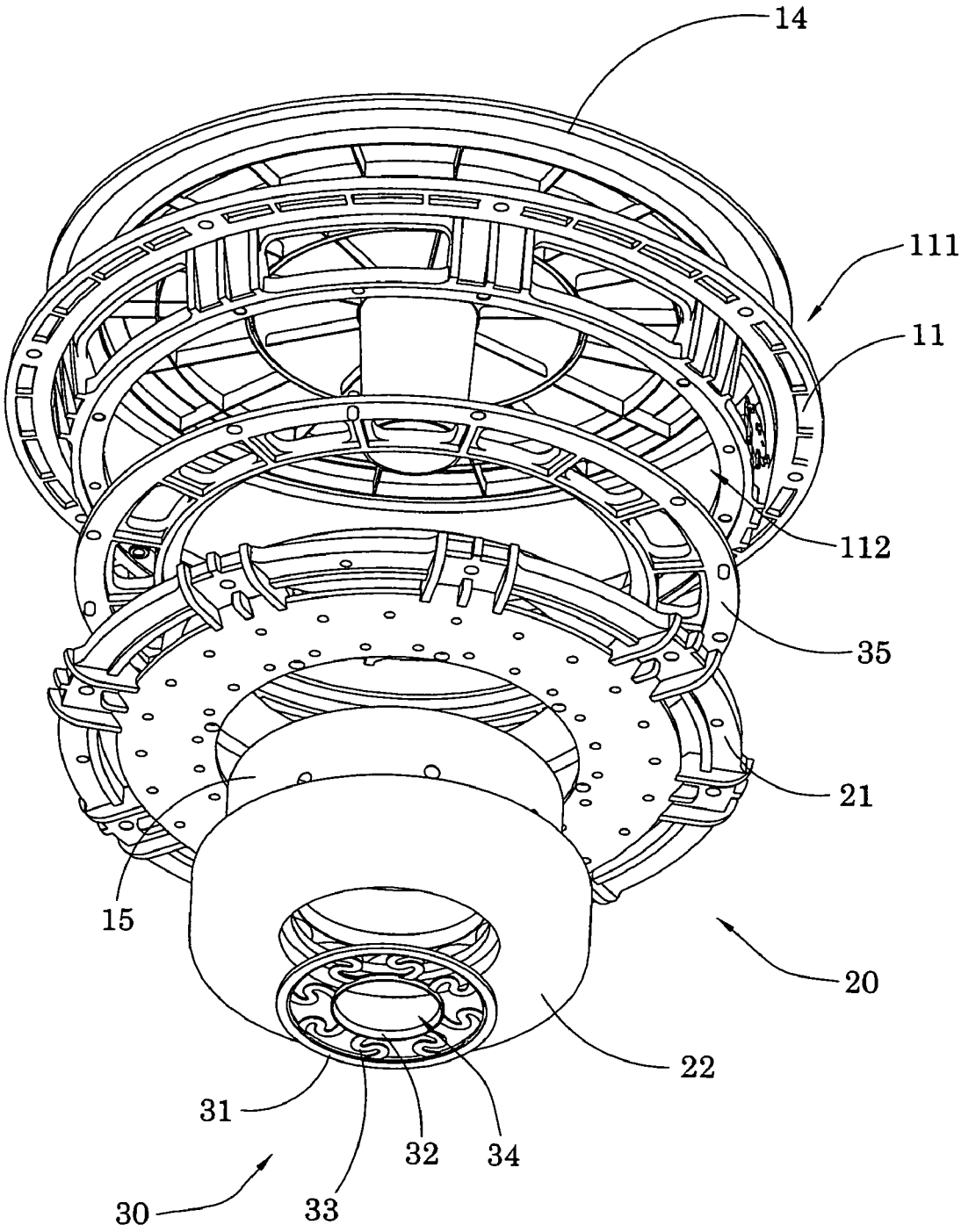
FIG. 3 is a bottom exploded perspective view of the electromagnetic vibrator with the spider arrangement according to the above preferred embodiment of the present invention.
Figure 4:
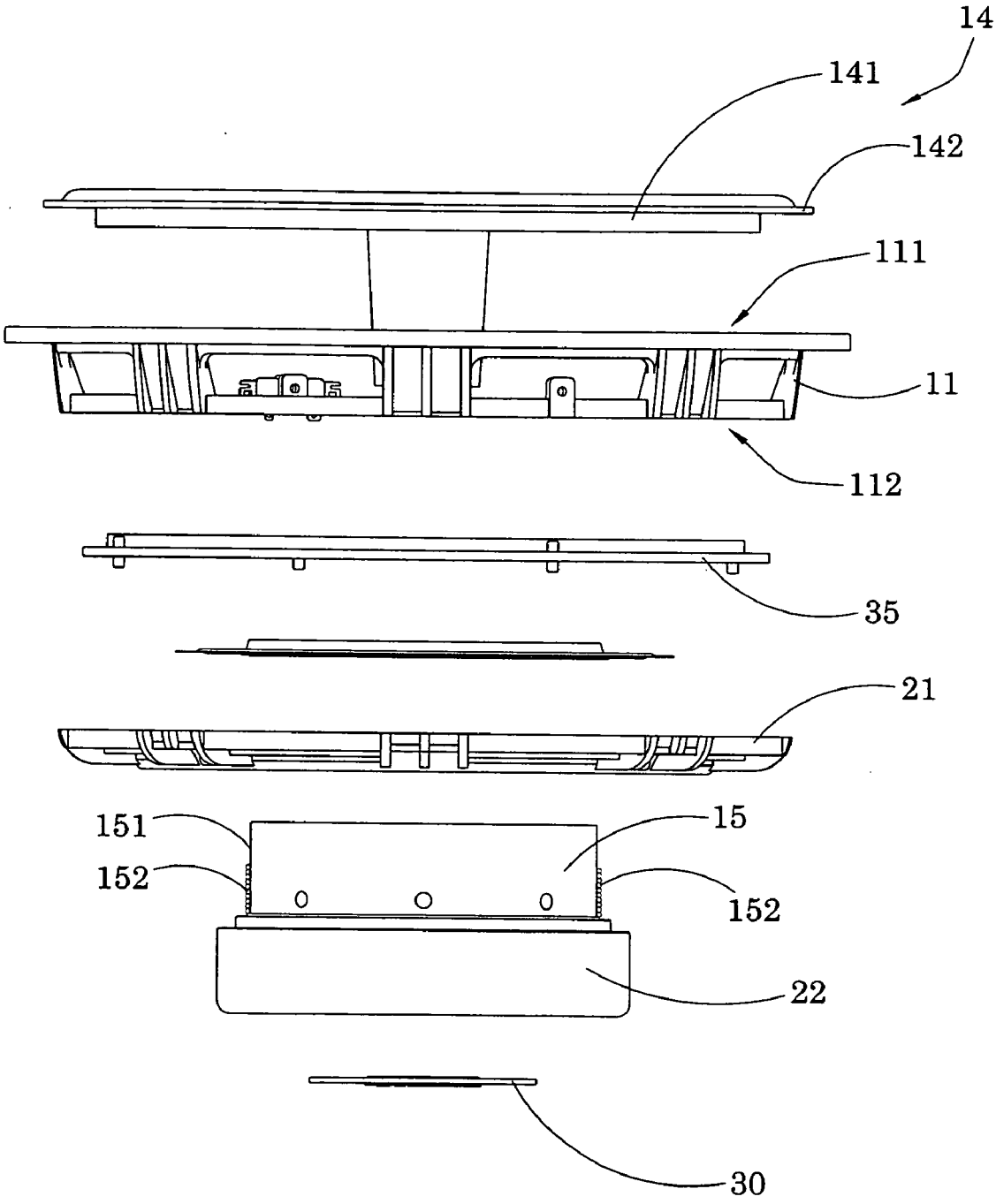
FIG. 4 is a side exploded view of the electromagnetic vibrator with the spider arrangement according to the above preferred embodiment of the present invention.

As shown in FIGS. 2 to 4, the spider arrangement 30 further comprises a spider frame 35 having a ring shape to support the outer rim 31 at the supporting frame 11 so as to ensure the inner rim 32 being coupled with the induction coil 15. Accordingly, the spider frame 35 has an outer ring securely affixing to the supporting frame 11 and an inner ring securely coupling with the outer rim 31. In other words, the outer rim 31 is supported at the supporting frame 11 through the spider frame 35. It is worth mentioning that the size of the outer rim 31 can be substantially reduced by incorporating with the spider frame 35. It is appreciated that the spider frame 35 can be omitted such that the outer rim 31 can be directly coupled with the supporting frame 11. However, the size of the outer rim 31 should be correspondingly increased to match with the size of the supporting frame 11.

In particularly, each of the suspension arms 33 has an "S" shape radially extended from the inner rim 32 to the outer rim 31, as shown in FIG. 4. Accordingly, one end of the "S" shaped suspension arm 33 is integrally affixed to the outer rim 31 while an opposed end of the "S" shaped suspension arm is integrally affixed to the inner rim 32, wherein the curving suspension portion of the suspension arm 33 is formed between the two ends thereof. In other words, each of the suspension arms 33 has two curving suspension portions 331 to create a larger suspension room for the inner rim 32 to move in responsive to the outer rim 31 so as to enhance the pistonic motion of the induction coil 15.

Figure 7:
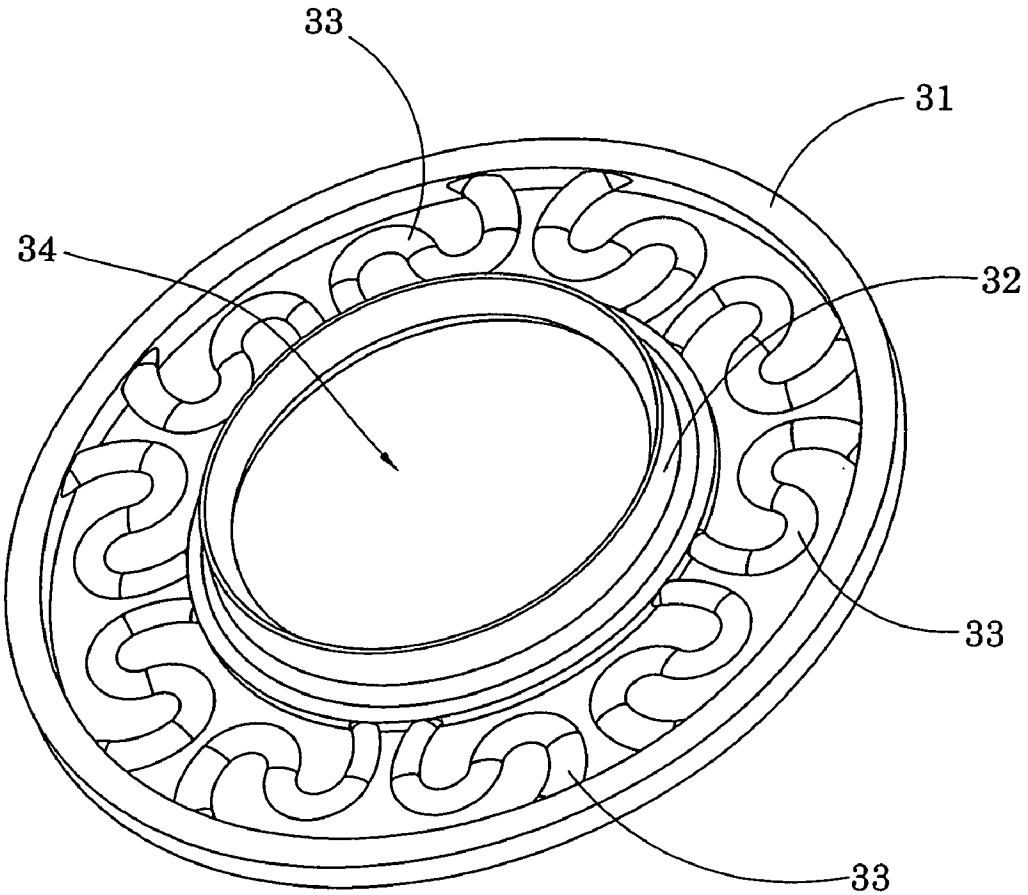
FIG. 7 illustrates a second alternative mode of the spider arrangement according to the above preferred embodiment of the present invention, wherein the embedded integral wiring arrangement is not shown in FIG. 7.

The two ends of the suspension arm 33 have different sizes. Each of the suspension arms 33 has a size gradually increasing from one end at the inner rim to another end at the outer rim, as shown in FIG. 5. Preferably, each of the suspension arms 33 has a size gradually decreasing from one end at the inner rim to another end at the outer rim, as shown in FIG. 7.

As it is mentioned above, the suspension arms 33 are configured in pairs. Having the "S" shaped configuration, the suspension arm 33 has a mirror reverse image of the neighboring suspension arm 33 to form a pair of the suspension arms 33, such that each pair of the suspension arms 33 provides a mutual biasing force for ensuring the induction coil 15 to freely and alignedly move in a pistonic motion with respect to the magnetic element 22. Accordingly, when all the suspension arms 33 are not form in pairs, the induction coil 15 will move not only the pistonic motion but also an unwanted lateral motion. Once the suspension arms are formed in pairs, each pair of suspension arms 33 will exert the mutual biasing force with each other. Since all the suspension arms 33 are identical and are evenly extended between the inner rim 32 and the outer rim 31, the mutual biasing force of each pair of the suspension arms 33 will be cancelled. As a result, the resultant force of the suspension arms 33 will be the electromagnetic force to drive the induction coil 15 to move in a pistonic motion.

Figure 8:
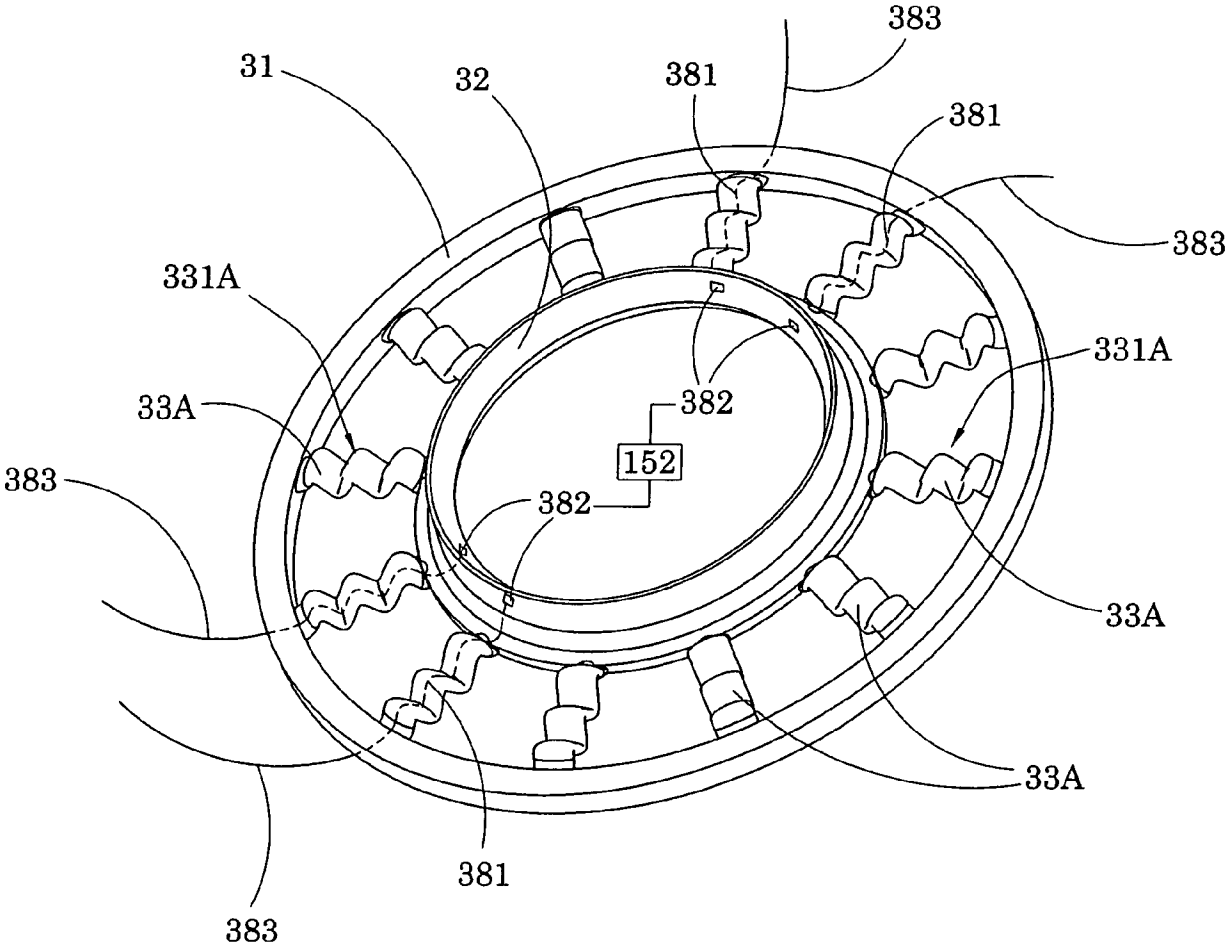
FIG. 8 is a perspective view of the spider arrangement according to a second preferred embodiment of the present invention.

Alternatively, each of the suspension arms 33A, which is made of flexible material to enable the inner rim 32 to move up and down with respect to the outer rim 31, has a corrugated shaped cross section radially extended from the inner rim to the outer rim, as shown in FIG. 8. Accordingly, each of the suspension arms 33A has two ends integrally extended from the inner and outer rims 32, 31 respectively to form a one-piece spider structure, wherein the curving suspension portion 331A of the suspension arm 33A is formed between the two ends thereof at the corrugated shaped of the suspension arm 33A. Accordingly, each of the suspension arms 33 has a uniform width and thickness extended from the inner rim 32 to the outer rim 31, as shown in FIG. 8.

Figure 9:
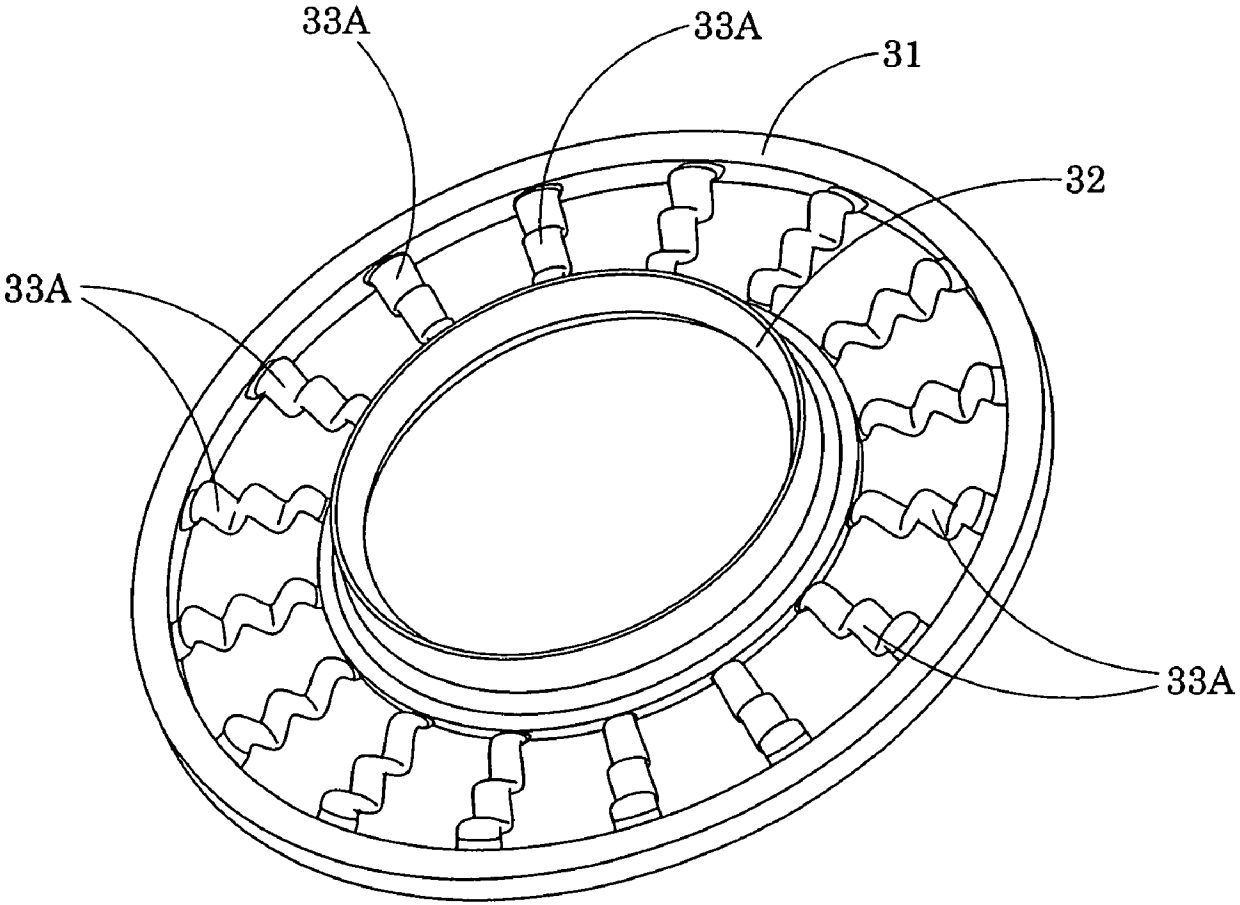
FIG. 9 illustrates a first alternative mode of the spider arrangement according to the above second preferred embodiment of the present invention, wherein the embedded integral wiring arrangement is not shown in FIG. 9.
Figure 10:
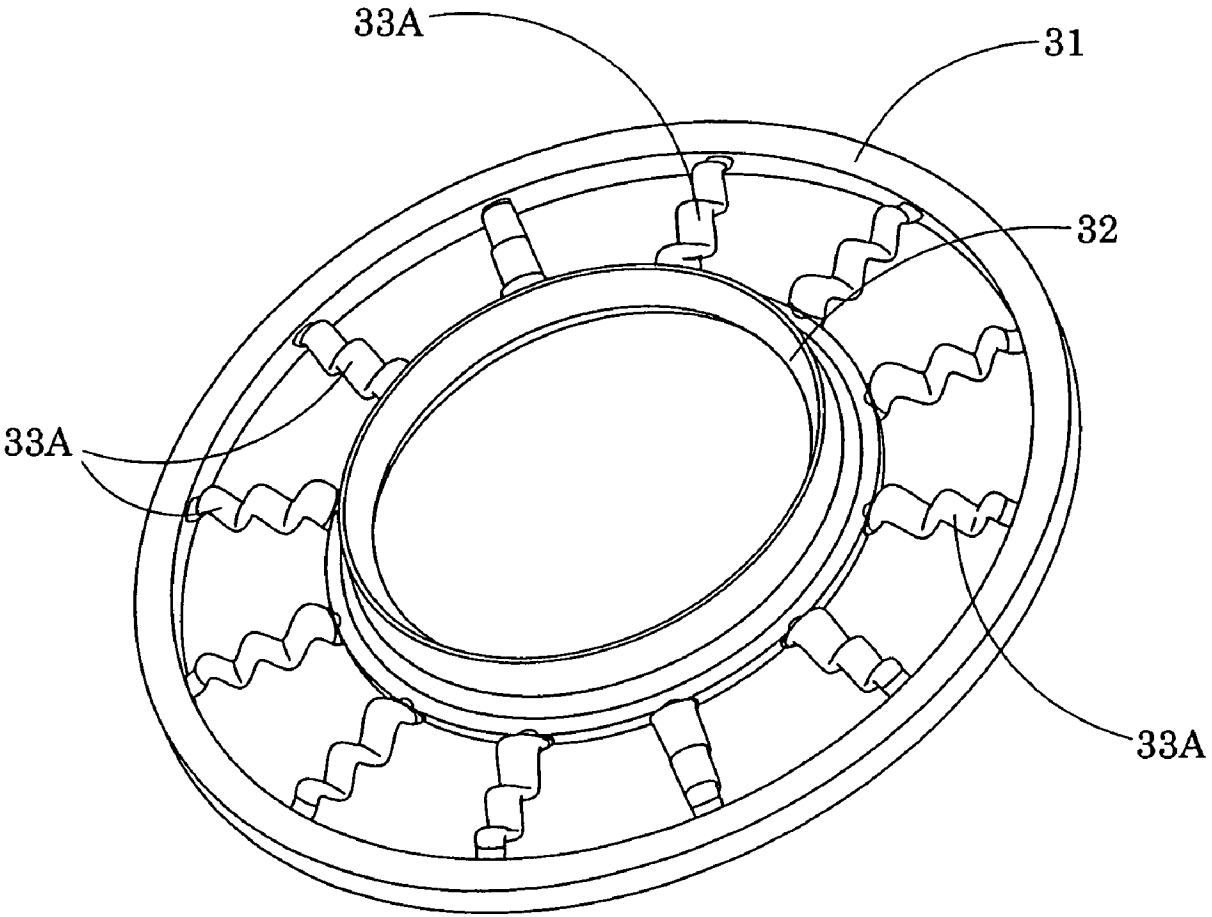
FIG. 10 illustrates a second alternative mode of the spider arrangement according to the second above preferred embodiment of the present invention, wherein the embedded integral wiring arrangement is not shown in FIG. 10.
Figure 11:
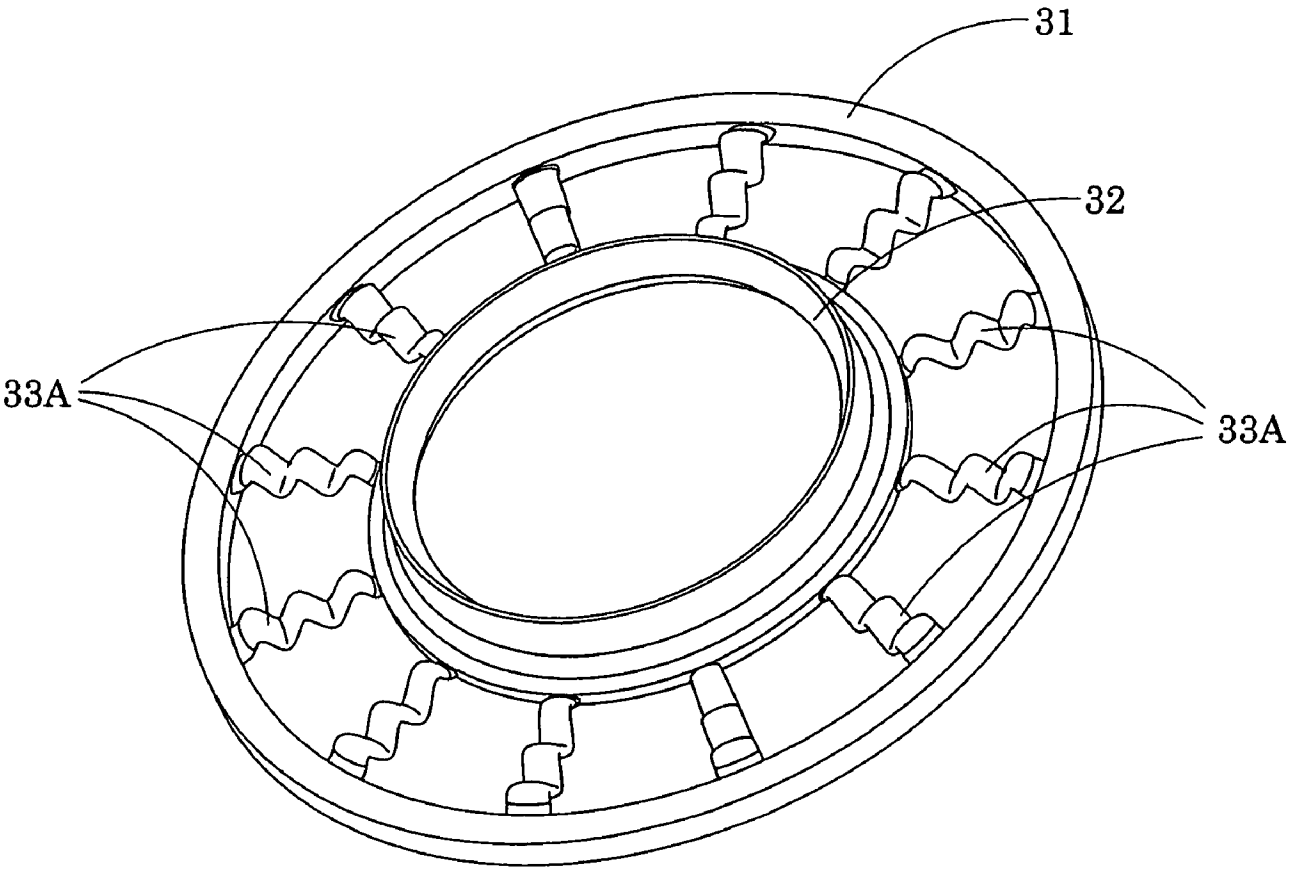
FIG. 11 illustrates a third alternative mode of the spider arrangement according to the second above preferred embodiment of the present invention, wherein the embedded integral wiring arrangement is not shown in FIG. 11.

FIG. 9 illustrates the number of the suspension arms 33A being increased and the size of each of the suspension arms 33A being reduced as one of the alternative mode of the suspension arm 33A. In addition, each of the suspension arms 33A has a width and thickness gradually decreasing from the inner rim 32 to the outer rim 31, as shown in FIG. 10. Likewise, the width and thickness of each of the suspension arms 33A can be gradually increased from the inner rim 32 to the outer rim 31, as shown in FIG. 11. It is worth to mention that the width and thickness of each of the suspension arms 33A can be selectively altered to fit the actual need for the electromagnetic vibrator for providing the suspension effect.

It is appreciated each of the suspension arms 33, 33A can be formed in a "C" shape radially extended from the inner rim 32 to the outer rim 31, wherein one end portion of the "C" shaped suspension arm 33 is integrally affixed to the outer rim 32 while an opposed end portion of the "C" shaped suspension arm 33 is integrally affixed to the inner rim 32. The curving suspension portion of the suspension arm is formed between the two end portions thereof. In addition, the "C"

shaped suspension arm has a mirror reverse image of the neighboring suspension arm to form a pair of the suspension arms.

According to the preferred embodiment, the spider arrangement 30 further comprises an integral wiring arrangement 38 operatively coupling with the induction coil 15. The integral wiring arrangement 38 comprises two or more induction wires 381 embedded with the suspension arms 33 respectively, wherein each of the induction wires 381 has a first terminal 382 extended to the inner rim 32 for electrically coupling with the induction coil 15 and a second terminal 383 extended towards the outer rim 31 for externally connection of the induction coil 15.

The first terminal 382 of the induction wire 381 is electrically coupled with one of the coil wire 152 of the induction coil 15 while the second terminal 383 of the induction wire 381 is electrically coupled with an external cable in such a manner that when the current passes through the external cable, the current is guide to pass to the coil wire 152 of the induction coil 15 through the induction wire 381 for electromangentically inducing with the magnetic field of the electromagnetic provider 20.

Accordingly, since the induction wires 381 are embedded with the suspension arms 33 respectively, the relatively vibration force at the diaphragm 14 to pull and push the induction coil 15 in a pistonic motion will be eliminated along the induction wires 381 so as to prevent the induction wires 381 from being broken during operation. In other words, the corresponding suspension arm 33 will strengthen the induction wire 384 by embedding the induction wire 381 within the suspension arm 33 to prevent the damage of the induction wire 381 when the induction coil 15 is driven to move axially. In addition, no suspending wire is required for connection to the induction coil 15 and hence any possible unwanted contact or overlapping of the coil wires and the wire is eliminated.

According to the preferred embodiment, the spider arrangement can be incorporated with any existing speaker, as shown in FIG. 5, wherein the outer rim 31 is affixed to the speaker frame (supporting frame) 11 while the inner rim 32 is affixed to the voice coil (induction coil) 15, such that when the voice coil 15 is inducted, each of the suspension arms 33 provides a restoring force towards the inner rim 32 for allowing the voice coil 15 to alignedly move in a pistonic motion with respect to the magnetic element 22 in a stable manner.

It is worth to mention that the present embodiment provides a spider arrangement for an electromagnetic vibrator having simple manufacturing steps to lower down the manufacturing time and cost. On the other hand, the shape and numbers of the electromagnetic vibrator are changeable so as to meet the different requirement of sound usage. Finally, a spider arrangement for an electromagnetic vibrator having a plurality of suspension arms in an even number and a suitable shape radially not only provides higher sound quality, improve durability, and but also enhance safety for a speaker.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A spider arrangement for an electromagnetic vibrator which comprises an induction coil supported within a supporting frame to electromagnetically communicate with a magnetic element in an axially movable manner so as to generate a vibration force at a diaphragm, wherein said spider arrangement comprises:

an outer rim adapted for mounting to said supporting frame;

an inner rim coaxially aligning with said outer rim for mounting to said induction coil;

a plurality of suspension arms radially and evenly extended from said inner rim to said outer rim to enable said inner rim to be moved axially in responsive to an electromagnetic force between said induction coil and said magnetic element, wherein said outer rim, said inner rim, and said suspension arms are molded that said suspension arms are integrally extended between said inner and outer rims to form a one-piece spider structure, wherein each of said suspension arms provides a restoring force towards said inner rim for allowing said induction coil to alignedly move in a pistonic motion with respect to said magnetic element in a stable manner, wherein said suspension arms are provided in an even number such that said suspension arms provide evenly restoring forces towards said inner rim; and an integral wiring arrangement for operatively coupling with said induction coil, wherein said integral wiring arrangement comprises two or more induction wires integrally embedded with two or more of said suspension arms respectively, wherein each of said induction wires has a first terminal extended to said inner rim for electrically coupling with said induction coil and a second terminal extended towards said outer rim for externally connection of said induction coil.

2. The spider arrangement, as recited in claim 1, wherein each of said suspension arms has two ends integrally extended from said inner and outer rims respectively to form a one-piece spider structure, wherein said two ends of each of said suspension arms have different sizes.

3. The spider arrangement, as recited in claim 2, wherein each of said suspension arms has a size gradually increasing from one end at said inner rim to another end at said outer rim.

4. The spider arrangement, as recited in claim 2, wherein each of said suspension arms has a size gradually decreasing from one end at said inner rim to another end at said outer rim.

5. The spider arrangement, as recited in claim 1, wherein each of said suspension arms, which is made of flexible material, has at least a curving suspension portion located between said inner and outer rims to provide enough room for said inner rim radially moving in a pistonic motion in responsive to said induction coil.

6. The spider arrangement, as recited in claim 3, wherein each of said suspension arms, which is made of flexible material, has at least a curving suspension portion located between said inner and outer rims to provide enough room for said inner rim radially moving in a pistonic motion in responsive to said induction coil.

7. The spider arrangement, as recited in claim 4, wherein each of said suspension arms, which is made of flexible material, has at least a curving suspension portion located between said inner and outer rims to provide enough room for said inner rim radially moving in a pistonic motion in responsive to said induction coil.

8. The spider arrangement, as recited in claim 1, wherein each of said suspension arms has a "S" shape radially extended from said inner rim to said outer rim.

9. The spider arrangement, as recited in claim 6, wherein each of said suspension arms has a "S" shape radially extended from said inner rim to said outer rim.

10. The spider arrangement, as recited in claim 7, wherein each of said suspension arms has a "S" shape radially extended from said inner rim to said outer rim.

11. The spider arrangement, as recited in claim 8, wherein said suspension arms are configured in pairs that said suspension arm has a mirror reverse image of said neighboring suspension arm to form a pair of said suspension arms, such that each pair of said suspension arms provides a mutual biasing force for ensuring said induction coil to freely and alignedly move in a pistonic motion with respect to said magnetic element.

12. The spider arrangement, as recited in claim 9, wherein said suspension arms are configured in pairs that said suspension arm has a mirror reverse image of said neighboring suspension arm to form a pair of said suspension arms, such that each pair of said suspension arms provides a mutual biasing force for ensuring said induction coil to freely and alignedly move in a pistonic motion with respect to said magnetic element.

13. The spider arrangement, as recited in claim 10, wherein said suspension arms are configured in pairs that said suspension arm has a mirror reverse image of said neighboring suspension arm to form a pair of said suspension arms, such that each pair of said suspension arms provides a mutual biasing force for ensuring said induction coil to freely and alignedly move in a pistonic motion with respect to said magnetic element.

14. The spider arrangement, as recited in claim 1, wherein each of said suspension arms has a corrugated shaped cross section radially extended from said inner rim to said outer rim.

15. The spider arrangement, as recited in claim 6, wherein each of said suspension arms has a corrugated shaped cross section radially extended from said inner rim to said outer rim.

16. The spider arrangement, as recited in claim 7, wherein each of said suspension arms has a corrugated shaped cross section radially extended from said inner rim to said outer rim.

17. The spider arrangement, as recited in claim 1, wherein each of said suspension arms has a corrugated shaped cross section radially extended from said inner rim to said outer rim, wherein each of said suspension arms has a width and thickness decreasing from said inner rim to said outer rim.

18. The spider arrangement, as recited in claim 5, wherein each of said suspension arms has a corrugated shaped cross section radially extended from said inner rim to said outer rim, wherein each of said suspension arms has a width and thickness decreasing from said inner rim to said outer rim.

19. The spider arrangement, as recited in claim 1, wherein each of said suspension arms has a corrugated shaped cross section radially extended from said inner rim to said outer rim, wherein each of said suspension arms has a width and thickness increasing from said inner rim to said outer rim.

20. The spider arrangement, as recited in claim 5, wherein each of said suspension arms has a corrugated shaped cross section radially extended from said inner rim to said outer rim, wherein each of said suspension arms has a width and thickness increasing from said inner rim to said outer rim.

* * * * *